US009701456B2

(12) United States Patent
Franca et al.

(10) Patent No.: US 9,701,456 B2
(45) Date of Patent: Jul. 11, 2017

(54) FLEXIBLE CONTAINER WITH EXTENDABLE SPOUT

(71) Applicant: Dow Global Technologies LLC, Midland, MI (US)

(72) Inventors: Marcos Franca, Sao Paulo (BR); Bruno Rufato Pereira, Sao Paulo (BR); Liangkai Ma, Midland, MI (US); Sam L. Crabtree, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 34 days.

(21) Appl. No.: 14/871,608

(22) Filed: Sep. 30, 2015

(65) Prior Publication Data

US 2017/0088328 A1 Mar. 30, 2017

(51) Int. Cl.

| | |
|---|---|
| ***B65D 75/58*** | (2006.01) |
| ***B65D 30/08*** | (2006.01) |
| ***B65D 30/20*** | (2006.01) |
| ***B65D 30/24*** | (2006.01) |
| ***B65D 47/06*** | (2006.01) |

(52) U.S. Cl.

CPC ..... *B65D 75/5877* (2013.01); *B65D 31/04* (2013.01); *B65D 31/10* (2013.01); *B65D 31/147* (2013.01); *B65D 47/063* (2013.01)

(58) Field of Classification Search

CPC .. B65D 75/5877; B65D 31/10; B65D 31/147; B65D 31/04

USPC ..... 222/529, 92, 105, 107, 153.05

See application file for complete search history.

(56) References Cited

U.S. PATENT DOCUMENTS

| | | | |
|---|---|---|---|
| 2,049,900 | A | 7/1935 | Evans et al. |
| 4,066,190 | A | 1/1978 | Chlystun |
| 4,693,400 | A | 9/1987 | Frahm et al. |
| 5,115,950 | A | 5/1992 | Rohr |
| 5,783,638 | A | 7/1998 | Lai et al. |
| 5,975,380 | A | 11/1999 | West, Jr. |

(Continued)

FOREIGN PATENT DOCUMENTS

| | | | |
|---|---|---|---|
| CA | 2739976 | A1 | 4/2012 |
| DE | 4440513 | A1 | 5/1996 |

(Continued)

OTHER PUBLICATIONS

Dobrynin, J. Chem. Phys., 107(21), Dec. 1997, pp. 9234-9238.
Potemkin et al., Physical Review E, vol. 57, No. 6, Jun. 1998, pp. 6902-6912.

*Primary Examiner* — Donnell Long
(74) *Attorney, Agent, or Firm* — Husch Blackwell LLP

(57) ABSTRACT

The present disclosure provides a flexible container. In an embodiment, a flexible container is provided and includes a first multilayer film and a second multilayer film. Each multilayer film has an inner seal layer. The multilayer films are arranged such that the seal layers oppose each other and the second multilayer film is superimposed on the first multilayer film. The multilayer films are sealed along a common peripheral edge. An orifice is present in one of the multilayer films. The flexible container includes an extendable spout extending through the orifice. The extendable spout has a flange sealed to the inner seal layer of the multilayer film at the orifice. The extendable spout is composed of, or is otherwise formed from, an ethylene/α-olefin multi-block copolymer.

14 Claims, 7 Drawing Sheets

(56) References Cited

U.S. PATENT DOCUMENTS

| | | | | |
|---|---|---|---|---|
| 7,608,668 | B2 | 10/2009 | Li Pi Shan et al. | |
| 7,832,576 | B2 | 11/2010 | Cohn | |
| 7,858,706 | B2 | 12/2010 | Arriola et al. | |
| 7,893,166 | B2 | 2/2011 | Shan et al. | |
| 7,947,793 | B2 | 5/2011 | Marchand et al. | |
| 8,348,509 | B2 * | 1/2013 | Wilkes | B65D 75/008 383/10 |
| 2002/0148857 | A1 * | 10/2002 | Savage | B65D 75/5877 222/107 |
| 2006/0201976 | A1 | 9/2006 | Bloom et al. | |
| 2010/0038386 | A1 * | 2/2010 | Pritchard | B65D 33/065 222/522 |
| 2011/0056965 | A1 | 3/2011 | Peer et al. | |
| 2012/0085793 | A1 * | 4/2012 | Selina | B65D 47/063 222/529 |
| 2012/0085794 | A1 | 4/2012 | Selina et al. | |

FOREIGN PATENT DOCUMENTS

| | | | |
|---|---|---|---|
| EP | 0395380 | A2 | 10/1990 |
| GB | 760495 | A | 10/1956 |

* cited by examiner

FLEXIBLE CONTAINER WITH EXTENDABLE SPOUT

BACKGROUND

The present disclosure is directed to fitments for flexible containers.

Known are flexible pouches with fitments. A fitment is a rigid pour spout for delivery of flowable material from a flexible container or a flexible pouch. Such pouches are often referred to as "pour-pouches."

Conventional pour pouches typically include a fitment with a canoe-shaped base that is sandwiched between opposing flexible films and heat sealed along the peripheral edge of the pouch. As such, the location of the fitment is restricted—limited to the edge of the pour pouch. The limited peripheral location of the fitment also limits the pour geometry of the pour pouch. Moreover, sealing the fitment to the pouch edge is problematic because it requires precise alignment between the fitment base and the flexible films in order to reduce the risk of poor seal. Consequently, production procedures without the requisite degree of precision suffer from high seal failure rates.

The art recognizes the need for flexible pouches that are not limited to fitment location along the peripheral edge of the package and also recognizes the need to reduce the incidence of leakage during flexible pouch production. The art further recognizes the need for flexible pouches having alternate pour geometries other than those provided by peripheral edge fitments.

SUMMARY

The present disclosure provides a flexible container with a surface mounted extendable spout. The extendable spout location is not limited to the peripheral edge of the flexible containers. The extendable spout has a telescopic spout design which provides improved flow direction and volume control to the flexible container.

The present disclosure provides a flexible container. In an embodiment, a flexible container is provided and includes a first multilayer film and a second multilayer film. Each multilayer film has an inner seal layer. The multilayer films are arranged such that the seal layers oppose each other and the second multilayer film is superimposed on the first multilayer film. The multilayer films are sealed along a common peripheral edge. An orifice is present in one of the multilayer films. The flexible container includes an extendable spout extending through the orifice. The extendable spout has a flange sealed to the inner seal layer of the multilayer film at the orifice. The extendable spout is composed of, or is otherwise formed from, an ethylene/α-olefin multi-block copolymer.

The present disclosure provides another flexible container. In an embodiment, a flexible container is provided and includes a front panel and a rear panel. The front panel is superimposed on the rear panel. The flexible container includes a first gusset panel and an opposing second gusset panel located between the front panel and the rear panel. Each panel is composed of a multilayer film. Each multilayer film includes an inner seal layer. The panels are heat sealed along a common peripheral edge. An orifice is present in one of panels. An extendable spout extends through the orifice. The extendable spout has a flange sealed to the inner seal layer of the panel at the orifice. The extendable spout is composed of, or is otherwise formed from, an ethylene/α-olefin multi-block copolymer.

An advantage of the present disclosure is a flexible container with an extendable spout that can be utilized with form-fill and seal production equipment.

An advantage of the present disclosure is a flexible container with an injection molded extendable spout having a flexible valve made in the same injection molding operation and made of the same material as the spout.

An advantage of the present disclosure is a flexible container with an extendable spout that provides improved flow control for pouring of flowable material, such as liquids.

An advantage of the present disclosure is an ethylene/α-olefin multi-block copolymer extendable spout offering comfort for the user in situations where the spout is taken directly to the person's mouth for consuming a comestible contained in the flexible container.

An advantage of the present disclosure is a flexible container with a flexible and elastic extendable spout that can serve as a nipple or straw for the suction removal of content from the flexible container.

An advantage of the present disclosure is a flexible container with an extendable spout that is protected by a peel seal adhesive (PSA) film that prevents premature extension of the spout. The PSA also provides aseptic conditions for the extendable spout prior use and serves as a tamper evident proof for the consumer.

DEFINITIONS

Figure 1:
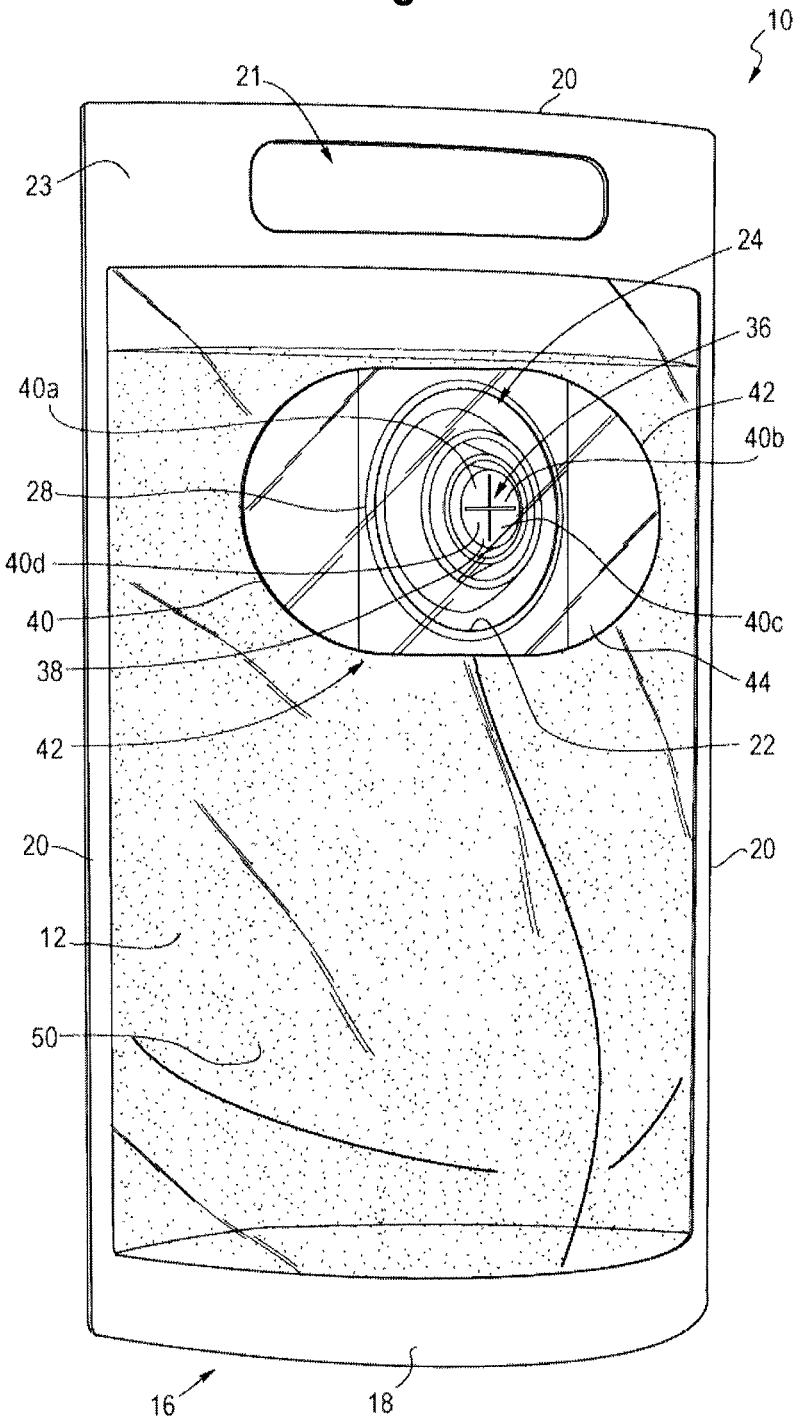
FIG. 1 is a perspective view of a flexible container in accordance with an embodiment of the present disclosure.

All references to the Periodic Table of the Elements herein shall refer to the Periodic Table of the Elements, published and copyrighted by CRC Press, Inc., 2003. Also, any references to a Group or Groups shall be to the Groups or Groups reflected in this Periodic Table of the Elements using the IUPAC system for numbering groups. Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference), especially with respect to the disclosure of synthetic techniques, definitions (to the extent not inconsistent with any definitions provided herein) and general knowledge in the art.

The numerical ranges disclosed herein include all values from, and including, the lower value and the upper value. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

Density is measured in accordance with ASTM D 792.

Elastic recovery is measured as follows. Stress-strain behavior in uniaxial tension is measured using an Instron™ universal testing machine at 300% $min^{-1}$ deformation rate at 21° C. The 300% elastic recovery is determined from a loading followed by unloading cycle to 300% strain, using ASTM D 1708 microtensile specimens. Percent recovery for all experiments is calculated after the unloading cycle using the strain at which the load returned to the base line. The percent recovery is defined as:

$$\% \text{ Recovery}=100*(Ef-Es)/Ef$$

where Ef is the strain taken for cyclic loading and Es is the strain where the load returns to the baseline after the unloading cycle.

An "ethylene-based polymer," as used herein is a polymer that contains more than 50 mole percent polymerized ethylene monomer (based on the total amount of polymerizable monomers) and, optionally, may contain at least one comonomer.

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

Shore A hardness is measured in accordance with ASTM D 2240.

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

The term "heat seal initiation temperature," indicates the minimum sealing temperature required to form a seal of significant strength, in this case, 2 lb/in (8.8N/25.4 mm). The seal is performed in a TopWave™ HT tester with 0.5 seconds dwell time at 2.7 bar (40 psi) seal bar pressure. The sealed specimen is tested in an INSTRON® Tensiomer at 10 in/min (4.2 mm/sec or 250 mm/min).

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

DETAILED DESCRIPTION

The present disclosure provides a flexible container. In an embodiment, the flexible container includes a first multilayer film and a second multilayer film. Each multilayer film includes an inner seal layer. The multilayer films are arranged such that seal layers oppose each other and the second multilayer film is superimposed on the first multilayer film. The multilayer films are sealed along a common peripheral edge. An orifice is present in one of the multilayer films. An extendable spout extends through the orifice. The extendable spout has a flange sealed to the seal layer at the orifice. The extendable spout is composed of an ethylene/α-olefin multi-block copolymer.

1. Flexible Container

The present flexible container includes a first multilayer film and a second multilayer film. It is understood the flexible container can include two, three, four, five, or six or more multilayer films. Each multilayer film is flexible and has at least two, or at least three layers. The flexible multilayer film is resilient, flexible, deformable, and pliable. The structure and composition for each multilayer film may be the same or different. For example, each of two opposing multilayer films can be made from a separate web, each web having a unique structure and/or unique composition, finish, or print. Alternatively, each multilayer film can be the same structure and the same composition.

In an embodiment, each multilayer film is a flexible multilayer film having the same structure and the same composition.

Each flexible multilayer film may be (i) a coextruded multilayer structure or (ii) a laminate, or (iii) a combination of (i) and (ii). In an embodiment, each flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

Nonlimiting examples of suitable polymeric materials for the seal layer include olefin-based polymer (including any ethylene/$C_3$-$C_{10}$ α-olefin copolymers linear or branched), propylene-based polymer (including plastomer and elastomer, random propylene copolymer, and propylene impact copolymer), ethylene-based polymer (including plastomer), low density polyethylene ("LDPE"), linear low density polyethylene ("LLDPE"), ethylene-acrylic acid or ethylene-methacrylic acid and their ionomers with zinc, sodium, lithium, potassium, magnesium salts, ethylene vinyl acetate copolymers and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6, Nylon 6,6, Nylon 6,66, Nylon 6,12, Nylon 12 etc.), polyethylene norbornene, cyclic olefin copolymers, polyacrylonitrile, polyesters, copolyesters (such as PETG), cellulose esters, polyethylene (such as HDPE) and copolymers of ethylene (e.g., LLDPE based on ethylene octene copolymer such as DOWLEX™, blends thereof, and multilayer combinations thereof.

Nonlimiting examples of suitable polymeric materials for the tie layer include functionalized ethylene-based polymers such as ethylene-vinyl acetate ("EVA"), polymers with maleic anhydride-grafted to polyolefins such as any polyethylene, ethylene-copolymers, or polypropylene, and ethylene acrylate copolymers such an ethylene methyl acrylate ("EMA"), glycidyl containing ethylene copolymers, propylene and ethylene based olefin block copolymers (OBC) such as INTUNE™ (PP-OBC) and INFUSE™ (PE-OBC) both available from The Dow Chemical Company, and blends thereof.

The flexible multilayer film may include additional layers which may contribute to the structural integrity or provide specific properties. The additional layers may be added by direct means or by using appropriate tie layers to the adjacent polymer layers. Polymers which may provide additional mechanical/optical performance such as stiffness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN™ resins available from The Dow Chemical Company); vinylethylene vinyl alcohol (EVOH), metal foil (such as aluminum foil). Alternatively, modified polymeric films such as vapor deposited aluminum or silicon oxide on such films as BON, OPET, or OPP, can be used to obtain barrier properties when used in laminate multilayer film.

In an embodiment, the flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, ethylene vinyl acetate (EVA), polymer such as VERSIFY™ (The Dow Chemical Company), grafted olefin-based polymer (MAH-grafted), and blends thereof. An optional tie layer is selected from either ethylene-based olefin block copolymer PE-OBC (sold as INFUSE™) or propylene-based olefin block copolymer PP-OBC (sold as INTUNE™). The outer layer includes greater than 50 wt % of resin(s) having a melting point, Tm, that is from 25° C. to 30° C., or 40° C. or higher than the melting point of the polymer in the seal layer wherein the outer layer polymer is selected from resins such as, LLDPE (DOWLEX™), VERSIFY™ or VISTAMAX, ELITE™, MDPE, HDPE or a propylene-based polymer such as propylene homopolymer, propylene impact copolymer or TPO.

In an embodiment, the flexible multilayer film is coextruded.

In an embodiment, flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, propylene-based plastomers or elastomers such as VERSIFY™ (The Dow Chemical Company), grafted olefin-based polymer (MAH-grafted), and blends thereof. The flexible multilayer film also includes an outer layer that is a polyamide.

In an embodiment, the flexible multilayer film is a coextruded and/or laminated film, the seal layer is composed of an ethylene-based polymer, such as a linear or a substantially linear polymer, or a single-site catalyzed linear or substantially linear polymer of ethylene and an alphα-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$. The outer layer is composed of a material selected from HDPE, LLDPE, OPET, OPP (oriented polypropylene), BOPP, polyamide, and combinations thereof.

In an embodiment, the flexible multilayer film is a coextruded and/or laminated film having at least five layers, the coextruded film having a seal layer composed of an ethylene-based polymer, such as a linear or substantially linear polymer, or a single-site catalyzed linear or substantially linear polymer of ethylene and an alphα-olefin comonomer such as 1-butene, 1-hexene or 1-octene, the ethylene-based polymer having a Tm from 55° C. to 115° C. and a density from 0.865 to 0.925 g/cm$^3$, or from 0.875 to 0.910 g/cm$^3$, or from 0.888 to 0.900 g/cm$^3$ and an outermost layer composed of a material selected from HDPE, LLDPE, OPET, OPP (oriented polypropylene), BOPP, polyamide, and combinations thereof.

In an embodiment, the flexible multilayer film is a coextruded and/or laminated film having at least seven layers. The seal layer is composed of an ethylene-based polymer, such as a linear or substantially linear polymer, or a single-site catalyzed linear or substantially linear polymer of ethylene and an alphα-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is composed of a material selected from HDPE, LLDPE, OPET, OPP (oriented polypropylene), BOPP, polyamide, and combinations thereof.

In an embodiment, the flexible multilayer film is a coextruded (or laminated) five layer film, or a coextruded (or laminated) seven layer film having at least two layers containing an ethylene-based polymer. The ethylene-based polymer may be the same or different in each layer.

In an embodiment, the flexible multilayer film is a coextruded and/or laminated five layer, or a coextruded (or laminated) seven layer film having at least one layer containing a material selected from HDPE, LLDPE, OPET, OPP (oriented polypropylene), BOPP, and polyamide.

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alphα-olefin monomer such as 1-butene, 1-hexene or 1-octene, having a $Tm_i$, from 90° C. to 106° C. The outer layer is a polyamide having a $Tm_o$ from 170° C. to 270° C. The film has a ΔTm ($\Delta Tm = Tm_o - Tm_i$) from 40° C. to 200° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

In an embodiment, a flexible container 10 is provided as shown in FIGS. 1-4. The flexible container 10 includes a first multilayer film 12 (front film 12) and a second multilayer film 14 (rear film 14). The multilayer films 12, 14 can be any flexible multilayer film as previously disclosed herein. The rear film 14 is superimposed on the front film 12. Each film 12, 14 has a respective seal layer containing an olefin-based polymer. The seal layer of front film 12 opposes the seal layer of the rear film 14.

The flexible container 10 also includes a gusset panel 16. The gusset panel 16 is formed from front film 12 and/or rear film 14. The gusset panel 16 includes a gusset rim 18. The gusset panel 16 provides (1) the structural integrity to support the flexible container and its contents without leakage, and (2) the stability for the flexible container to stand upright (gusset rim on a support surface, such as a horizontal surface, or a substantially horizontal surface), without tipping over. In this sense, the flexible container 10 is a "stand up pouch" or "SUP."

The front film 12 and the rear film 14 are sealed around a common peripheral edge 20. In an embodiment, the front film 12, the rear film 14, and the gusset rim 18 are heat sealed to each other along the common peripheral edge 20. The term "heat seal process" or "heat sealing," and like terms, as used herein, is the act of placing two or more films of polymeric material between opposing heat seal bars, the heat seal bars moved toward each other, sandwiching the films, to apply heat and pressure to the films such that opposing interior surfaces (seal layers) of the films contact, melt, and form a heat seal, or weld, to attach the films to each other. Heat sealing includes suitable structure and mechanism to move the seal bars toward and away from each other in order to perform the heat sealing procedure.

In an embodiment, a handle 21 is present in a top heat seal 23 of the flexible pouch 10. In a further embodiment, the handle 21 is a cut-out handle formed by side cuts and a bottom cut in the top seal 23, with flaps of the films attached along a top portion of the cut-out area. The flaps are folded to extend outward and thereby provide comfort to a person's hand with carrying, or otherwise handling, the flexible container 10 by way of the handle 21.

An orifice 22 is present in one of the multilayer films. The orifice 22 is sized, or otherwise configured, so that a portion of the extendable spout 24 extends through the orifice 22 and the diameter of the flange 28 is too large to pass through the orifice 22. In this way, the flange 28 is located in the container interior and the rest of the spout extends outward from the multilayer film.

2. Extendable Spout

The extendable spout 24 is composed of an ethylene/α-olefin multi-block copolymer. The extendible spout 24 is hollow and has a channel 26 extending therethrough. The extendable spout 24 includes a flange 28 at a proximate end and a dispensing outlet 30 (or outlet 30) at a distal end. A plurality of integrally connected foldable panels **32*a*-32*e* are present between the flange 28 and the outlet 30. The foldable panels are integrally connected by way of a plurality of hinges 34. The flange 28, the outlet 30, foldable panels 32*a*-32*e*, and the hinges 34 are connected, and each is composed of the same ethylene/α-olefin multi-block copolymer. Hinges 34 are weakened areas of the ethylene/α-olefin multi-block copolymer. The hinges 34 connect the foldable panels to each other and enable adjoining foldable panels to flex or hingedly move with respect to each other. The extendable spout 24** is an integral component.

Figure 2A:
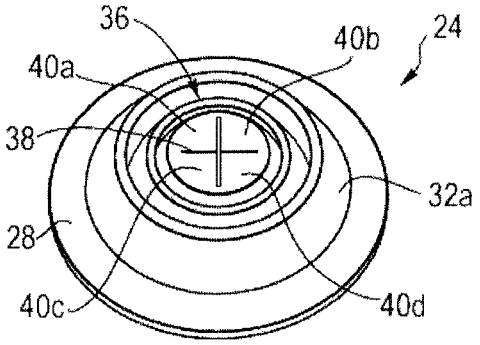
FIG. 2A is a perspective view of an expandable spout in a compressed configuration, in accordance with an embodiment of the present disclosure.
Figure 2B:
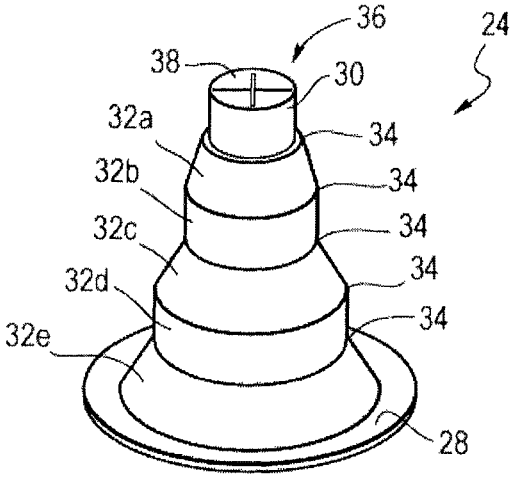
FIG. 2B is a perspective view of an expandable spout in an expanded configuration, in accordance with an embodiment of the present disclosure.
Figure 2C:
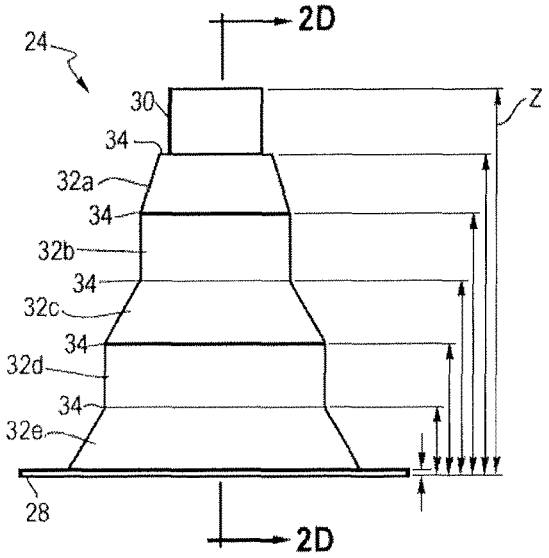
FIG. 2C is an elevation view of an expandable spout in an expanded configuration.
Figure 2D:
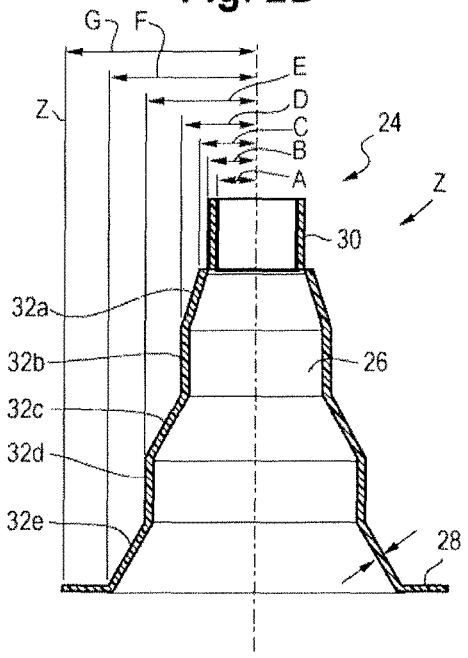
FIG. 2D is a sectional view of the expandable spout taken along line 2D-2D of FIG. 2C.
Figure 2E:
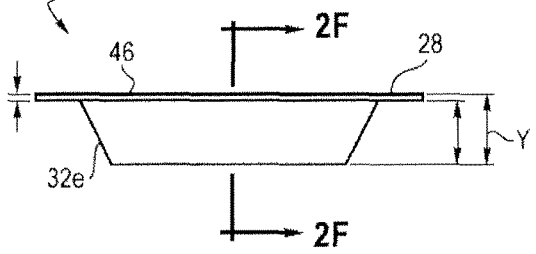
FIG. 2E is an elevation view of the expandable spout in the compressed configuration.
Figure 2F:
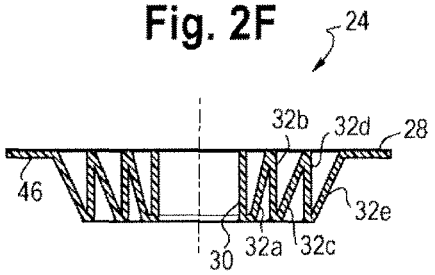
FIG. 2F is a sectional view of the expandable spout taken along line 2F-2F of FIG. 2E.

In an embodiment, the foldable panels 32*a*-32*e* are concentrically disposed with respect to each other. Although FIG. 2B shows extendable spout 24 with six foldable panels, it is understood that the flexible spout 24 can have from 2, or 3, or 4, or 5 to 6, or 7, or 8, or 9, or 10, or more foldable panels. The hinges 34 enable the foldable panels to fold upon themselves in an accordion-like manner whereby the panels fold in an alternating manner, resembling the bellows of an accordion, and as shown in FIG. 2F.

Individually, each foldable panel is a hollow tube, cylindrical, or substantially cylindrical, in shape. As shown in FIGS. 2C-2D, the diameter of each foldable panel 32*a*-32*e* decreases moving from the proximate end of the flexible spout (i.e., the flange 28) to the spout distal end (i.e., the outlet 30). In other words, the diameter of each panel (cylinder) is smaller than the preceding panel (cylinder), moving from the flange (proximate end) to the outlet (distal end).

In an embodiment, at the outlet 30 has a diameter A, as shown in FIG. 2D. Diameter A is less than diameter B of foldable panel 32*a*, that is less than diameter C of foldable panel 32*b*, that is less than diameter D of foldable panel 32*c*, that is less than diameter E of foldable panel 32*d*, that is less than diameter F of foldable channel 32*e*, that is less than diameter G of flange 28. In this way, the foldable panels concentrically nest within each other when in the compressed configuration Y. As shown in FIGS. 2A, and 2F, the outlet 30 is concentrically the innermost panel when in the compressed configuration Y. As shown in FIGS. 2C-2D, the outlet 30 has the smallest diameter and the flange 28 has the largest diameter.

A portion of the extendable spout 24 extends through the orifice 22. The flange 28 is located in the interior of the flexible container 10 and contacts the seal layer of one of the multilayer films, in this case the front film 12. The flange 28 is attached along the circumferential edge area of the front film 12 that defines the orifice. Attachment between the film seal layer and the flange 28 occurs by way of (i) heat seal, (ii) adhesive seal, and (iii) a combination of (i) and (ii).

The extendable spout 24 is composed of an ethylene/α-olefin multi-block copolymer. The term "ethylene/α-olefin multi-block copolymer" is a copolymer that includes ethylene and one or more copolymerizable α-olefin comonomers in polymerized form, characterized by multiple blocks or segments of two or more polymerized monomer units differing in chemical or physical properties. The term "ethylene/α-olefin multi-block copolymer" includes block copolymer with two blocks (di-block) and more than two blocks (multi-block). The terms "interpolymer" and "copolymer" are used interchangeably herein. When referring to amounts of "ethylene" or "comonomer" in the copolymer, it is understood that this means polymerized units thereof. In some embodiments, the ethylene/α-olefin multi-block copolymer can be represented by the following formula:

$$(AB)_n$$

Where n is at least 1, preferably an integer greater than 1, such as 2, 3, 4, 5, 10, 15, 20, 30, 40, 50, 60, 70, 80, 90, 100, or higher, "A" represents a hard block or segment and "B" represents a soft block or segment. Preferably, As and Bs are linked, or covalently bonded, in a substantially linear fashion, or in a linear manner, as opposed to a substantially branched or substantially star-shaped fashion. In other embodiments, A blocks and B blocks are randomly distributed along the polymer chain. In other words, the block copolymers usually do not have a structure as follows:

AAA-AA-BBB-BB

In still other embodiments, the block copolymers do not usually have a third type of block, which comprises different comonomer(s). In yet other embodiments, each of block A and block B has monomers or comonomers substantially randomly distributed within the block. In other words, neither block A nor block B comprises two or more sub-segments (or sub-blocks) of distinct composition, such as a tip segment, which has a substantially different composition than the rest of the block.

Preferably, ethylene comprises the majority mole fraction of the whole block copolymer, i.e., ethylene comprises at least 50 mole percent of the whole polymer. More preferably ethylene comprises at least 60 mole percent, at least 70 mole percent, or at least 80 mole percent, with the substantial remainder of the whole polymer comprising at least one other comonomer that is preferably an α-olefin having 3 or more carbon atoms, or 4 or more carbon atoms. In some embodiments, the ethylene/α-olefin multi-block copolymer may comprise 50 mol % to 90 mol % ethylene, or 60 mol % to 85 mol % ethylene, or 65 mol % to 80 mol % ethylene. For many ethylene/octene multi-block copolymers, the composition comprises an ethylene content greater than 80 mole percent of the whole polymer and an octene content of from 10 to 15, or from 15 to 20 mole percent of the whole polymer.

The ethylene/α-olefin multi-block copolymer includes various amounts of "hard" segments and "soft" segments. "Hard" segments are blocks of polymerized units in which ethylene is present in an amount greater than 90 weight percent, or 95 weight percent, or greater than 95 weight percent, or greater than 98 weight percent based on the weight of the polymer, up to 100 weight percent. In other words, the comonomer content (content of monomers other than ethylene) in the hard segments is less than 10 weight percent, or 5 weight percent, or less than 5 weight percent, or less than 2 weight percent based on the weight of the polymer, and can be as low as zero. In some embodiments, the hard segments include all, or substantially all, units derived from ethylene. "Soft" segments are blocks of polymerized units in which the comonomer content (content of monomers other than ethylene) is greater than 5 weight percent, or greater than 8 weight percent, greater than 10 weight percent, or greater than 15 weight percent based on the weight of the polymer. In some embodiments, the comonomer content in the soft segments can be greater than 20 weight percent, greater than 25 weight percent, greater than 30 weight percent, greater than 35 weight percent, greater than 40 weight percent, greater than 45 weight percent, greater than 50 weight percent, or greater than 60 weight percent and can be up to 100 weight percent.

The soft segments can be present in an ethylene/α-olefin multi-block copolymer from 1 weight percent to 99 weight percent of the total weight of the ethylene/α-olefin multi-block copolymer, or from 5 weight percent to 95 weight percent, from 10 weight percent to 90 weight percent, from 15 weight percent to 85 weight percent, from 20 weight percent to 80 weight percent, from 25 weight percent to 75 weight percent, from 30 weight percent to 70 weight percent, from 35 weight percent to 65 weight percent, from 40 weight percent to 60 weight percent, or from 45 weight percent to 55 weight percent of the total weight of the ethylene/α-olefin multi-block copolymer. Conversely, the hard segments can be present in similar ranges. The soft segment weight percentage and the hard segment weight percentage can be calculated based on data obtained from DSC or NMR. Such methods and calculations are disclosed in, for example, U.S. Pat. No. 7,608,668, entitled "Ethylene/α-Olefin Block Inter-polymers," filed on Mar. 15, 2006, in the name of Colin L. P. Shan, Lonnie Hazlitt, et al. and assigned to Dow Global Technologies Inc., the disclosure of which is incorporated by reference herein in its entirety. In particular, hard segment and soft segment weight percentages and comonomer content may be determined as described in Column 57 to Column 63 of U.S. Pat. No. 7,608,668.

The ethylene/α-olefin multi-block copolymer is a polymer comprising two or more chemically distinct regions or segments (referred to as "blocks") preferably joined (or covalently bonded) in a linear manner, that is, a polymer comprising chemically differentiated units which are joined end-to-end with respect to polymerized ethylenic functionality, rather than in pendent or grafted fashion. In an embodiment, the blocks differ in the amount or type of incorporated comonomer, density, amount of crystallinity, crystallite size attributable to a polymer of such composition, type or degree of tacticity (isotactic or syndiotactic), regio-regularity or regio-irregularity, amount of branching (including long chain branching or hyper-branching), homogeneity or any other chemical or physical property. Compared to block interpolymers of the prior art, including interpolymers produced by sequential monomer addition, fluxional catalysts, or anionic polymerization techniques, the present ethylene/α-olefin multi-block copolymer is characterized by unique distributions of both polymer polydispersity (PDI or Mw/Mn or MWD), polydisperse block length distribution, and/or polydisperse block number distribution, due, in an embodiment, to the effect of the shuttling agent(s) in combination with multiple catalysts used in their preparation.

In an embodiment, the ethylene/α-olefin multi-block copolymer is produced in a continuous process and possesses a polydispersity index (Mw/Mn) from 1.7 to 3.5, or from 1.8 to 3, or from 1.8 to 2.5, or from 1.8 to 2.2. When produced in a batch or semi-batch process, the ethylene/α-olefin multi-block copolymer possesses Mw/Mn from 1.0 to 3.5, or from 1.3 to 3, or from 1.4 to 2.5, or from 1.4 to 2.

In addition, the ethylene/α-olefin multi-block copolymer possesses a PDI (or Mw/Mn) fitting a Schultz-Flory distribution rather than a Poisson distribution. The present ethylene/α-olefin multi-block copolymer has both a polydisperse block distribution as well as a polydisperse distribution of block sizes. This results in the formation of polymer products having improved and distinguishable physical properties. The theoretical benefits of a polydisperse block distribution have been previously modeled and discussed in Potemkin, *Physical Review E* (1998) 57 (6), pp. 6902-6912, and Dobrynin, *J. Chem. Phys.* (1997) 107 (21), pp 9234-9238.

In an embodiment, the present ethylene/α-olefin multi-block copolymer possesses a most probable distribution of block lengths.

In a further embodiment, the ethylene/α-olefin multi-block copolymer of the present disclosure, especially those made in a continuous, solution polymerization reactor, possess a most probable distribution of block lengths. In one embodiment of this disclosure, the ethylene multi-block interpolymers are defined as having:

(A) Mw/Mn from about 1.7 to about 3.5, at least one melting point, Tm, in degrees Celsius, and a density, d, in grams/cubic centimeter, where in the numerical values of Tm and d correspond to the relationship:

$$Tm>-2002.9+4538.5(d)-2422.2(d)^2, \text{ and/or}$$

(B) Mw/Mn from about 1.7 to about 3.5, and is characterized by a heat of fusion, ΔH in J/g, and a delta quantity, ΔT, in degrees Celsius defined as the temperature difference between the tallest DSC peak and the tallest Crystallization Analysis Fractionation ("CRYSTAF") peak, wherein the numerical values of ΔT and ΔH have the following relationships:

$$\Delta T>-0.1299\ \Delta H)+62.81 \text{ for } \Delta H \text{ greater than zero and up to 130 J/g}$$

$$\Delta T\geq 48^\circ \text{ C. for } \Delta H \text{ greater than 130 J/g}$$

wherein the CRYSTAF peak is determined using at least 5 percent of the cumulative polymer, and if less than 5 percent of the polymer has an identifiable CRYSTAF peak, then the CRYSTAF temperature is 30° C.; and/or (C) elastic recovery, Re, in percent at 300 percent strain and 1 cycle measured with a compression-molded film of the ethylene/α-olefin interpolymer, and has a density, d, in grams/cubic centimeter, wherein the numerical values of Re and d satisfy the following relationship when ethylene/α-olefin interpolymer is substantially free of crosslinked phase:

$$Re>1481-1629(d); \text{ and/or}$$

(D) has a molecular weight fraction which elutes between 40° C. and 130° C. when fractionated using TREF, characterized in that the fraction has a molar comonomer content of at least 5 percent higher than that of a comparable random ethylene interpolymer fraction eluting between the same temperatures, wherein said comparable random ethylene interpolymer has the same comonomer(s) and has a melt index, density and molar comonomer content (based on the whole polymer) within 10 percent of that of the ethylene/α-olefin interpolymer; and/or (E) has a storage modulus at 25° C., G'(25° C.), and a storage modulus at 100° C., G'(100° C.), wherein the ratio of G'(25° C.) to G'(100° C.) is in the range of about 1:1 to about 9:1.

The ethylene/α-olefin multi-block copolymer may also have:

(F) molecular fraction which elutes between 40° C. and 130° C. when fractionated using TREF, characterized in that the fraction has a block index of at least 0.5 and up to about 1 and a molecular weight distribution, Mw/Mn, greater than about 1.3; and/or (G) average block index greater than zero and up to about 1.0 and a molecular weight distribution, Mw/Mn greater than about 1.3.

Suitable monomers for use in preparing the present ethylene/α-olefin multi-block copolymer include ethylene and one or more addition polymerizable monomers other than ethylene. Examples of suitable comonomers include straight-chain or branched α-olefins of 3 to 30, or 3 to 20, or 4 to 12 carbon atoms, such as propylene, 1-butene, 1-pentene, 3-methyl-I-butene, 1-hexene, 4-methyl-1-pentene, 3-methyl-1-pentene, 1-octene, 1-decene, 1-dodecene, 1-tetradecene, 1-hexadecene, 1-octadecene and 1-eicosene; cyclo-olefins of 3 to 30, or 3 to 20, carbon atoms, such as cyclopentene, cycloheptene, norbornene, 5-methyl-2-norbornene, tetracyclododecene, and 2-methyl-1,4,5,8-dimethano-1,2,3,4,4a,5,8,8a-octahydronaphthalene; di- and poly-olefins, such as butadiene, isoprene, 4-methyl-1,3-pentadiene, 1,3-pentadiene, 1,4-pentadiene, 1,5-hexadiene, 1,4-hexadiene, 1,3-hexadiene, 1,3-octadiene, 1,4-octadiene, 1,5-octadiene, 1,6-octadiene, 1,7-octadiene, ethylidenenorbornene, vinyl norbornene, dicyclopentadiene, 7-methyl-1,6-octadiene, 4-ethylidene-8-methyl-1,7-nonadiene, and 5,9-dimethyl-1,4,8-decatriene; and 3-phenylpropene, 4-phenylpropene, 1,2-difluoroethylene, tetrafluoroethylene, and 3,3,3-trifluoro-1-propene.

In an embodiment, the comonomer is selected from butene, hexene, and octene.

The ethylene/α-olefin multi-block copolymer can be produced via a chain shuttling process such as described in U.S. Pat. No. 7,858,706, which is herein incorporated by reference. In particular, suitable chain shuttling agents and related information are listed in Col. 16, line 39 through Col. 19, line 44. Suitable catalysts are described in Col. 19, line 45 through Col. 46, line 19 and suitable co-catalysts in Col. 46, line 20 through Col. 51 line 28. The process is described throughout the document, but particularly in Col. Col 51, line 29 through Col. 54, line 56. The process is also described, for example, in the following: U.S. Pat. Nos. 7,608,668; 7,893,166; and 7,947,793.

In an embodiment, the ethylene/α-olefin multi-block copolymer has hard segments and soft segments and is defined as having:

a Mw/Mn from 1.7 to 3.5, at least one melting point, Tm, in degrees Celsius, and a density, d, in grams/cubic centimeter, where in the numerical values of Tm and d correspond to the relationship:

$$Tm<-2002.9+4538.5(d)-2422.2(d)^2,$$

where d is from 0.86 g/cc, or 0.87 g/cc, or 0.88 g/cc to 0.89 g/cc;

and

Tm is from 80° C., or 85° C., or 90° C. to 95, or 99° C., or 100° C., or 105° C. to 110° C., or 115° C., or 120° C., or 125° C.

In an embodiment, the ethylene/α-olefin multi-block copolymer is an ethylene/octene multi-block copolymer and has one, some, any combination of, or all the properties (i)-(ix) below:

(i) a melt temperature (Tm) from 80° C., or 85° C., or 90° C. to 95, or 99° C., or 100° C., or 105° C. to 110° C., or 115° C., or 120° C., or 125° C.;

(ii) a density from 0.86 g/cc, or 0.87 g/cc, or 0.88 g/cc to 0.89 g/cc;

(iii) 50-85 wt % soft segment and 40-15 wt % hard segment;

(iv) from 10 mol %, or 13 mol %, or 14 mol %, or 15 mol % to 16 mol %, or 17 mol %, or 18 mol %, or 19 mol %, or 20 mol % octene in the soft segment;

(v) from 0.5 mol %, or 1.0 mol %, or 2.0 mol %, or 3.0 mol % to 4.0 mol %, or 5 mol %, or 6 mol %, or 7 mol %, or 9 mol % octene in the hard segment;

(vi) a melt index (MI) from 1 g/10 min, or 2 g/10 min, or 5 g/10 min, or 7 g/10 min, to 10 g/10 min, or 15 g/10 min to 20 g/10 min;

(vii) a Shore A hardness from 65, or 70, or 71, or 72 to 73, or 74, or 75, or 77, or 79, of 80;

(viii) an elastic recovery (Re) from 50%, or 60% to 70%, or 80%, or 90%, at 300% $min^{-1}$ deformation rate at 21° C. as measured in accordance with ASTM D 1708; and (ix) a polydisperse distribution of blocks and a polydisperse distribution of block sizes.

In an embodiment, the ethylene/α-olefin multi-block copolymer is an ethylene/octene multi-block copolymer.

The present ethylene/α-olefin multi-block copolymer may comprise two or more embodiments disclosed herein.

The ethylene/α-olefin multi-block copolymer can be a sole component or can be blended with other olefin-based polymers. Nonlimiting examples of suitable olefin-based polymers as blend components include propylene-based polymer, LDPE, LLDPE, HDPE, and combinations thereof.

In an embodiment, the ethylene/octene multi-block copolymer is sold under the Tradename INFUSE™ available from The Dow Chemical Company, Midland, Mich., USA. In a further embodiment, the ethylene/octene multi-block copolymer is INFUSET™ 9817.

In an embodiment, the ethylene/octene multi-block copolymer is INFUSE™ 9500.

In an embodiment, the ethylene/octene multi-block copolymer is INFUSE™ 9507.

In an embodiment, the ethylene/α-olefin multi-block copolymer has a melt temperature, Tm1, from 115° C., or 116° C., or 118° C., or 120° C. to 121° C., or 122° C., or 123° C., or 124° C., or 125° C. The seal layer of the multilayer film (i.e., front film 12) is composed of an olefin based polymer (an ethylene-based polymer or a propylene-based polymer) having a melt temperature, Tm2, that is from 10° C., or 11° C., or 12° C., or 13° C., or 14° C., or 15° C., or 17° C., or 19° C., or 20° C. to 21° C., or 22° C., or 25° C., or 27° C., or 30° C., or 33° C., or 35° C., or 37° C., or 39° C., or 40° C. less than Tm1. The melt temperature relationship between the extendable spout polymer and the seal layer polymer is shown in Equation 1 below.

$$Tm1-Tm2=\text{from } 10^\circ \text{ C. to } 40^\circ \text{ C.} \qquad \text{Equation 1}$$

Applicant discovered that an extendable spout composed of an ethylene/α-olefin multi-block copolymer with Tm1 and a seal layer olefin-based polymer with Tm2 that meets Equation 1 demonstrate strong seal compatability. Heat sealing the flange 28 to the multilayer film seal layer that is an ethylene-based polymer fulfilling Equation 1 unexpectedly yields a hermetic seal.

In an embodiment, the seal layer is composed of an ethylene-based polymer that meets Equation 1. In a further embodiment, the seal layer ethylene-based polymer also has a heat seal initiation temperature less than 100° C. In yet a further embodiment, the seal layer ethylene-based polymer has a heat seal initiation temperature from 80° C., or 81° C., or 85° C., or 90° C. to 95° C., or 96° C., or 98° C., or 99° C., or less than 100° C.

3. Flexible Valve

In an embodiment, the extendable spout 24 includes a flexible valve 36. The flexible valve 36 is located in the outlet 30.

The flexible valve 36 controls the flow of a flowable material through the channel 26. The shape of the flexible valve 36 can be flat, convex, or concave. The flexible valve 36 has a thickness from 0.1 mm, or 0.2 mm, or 0.3 mm, or 0.4 mm, or 0.5 mm to 0.6 mm, or 0.7 mm, or 0.8 mm, or 0.9 mm, or less the 1.0 mm, or 1.0 mm.

The flexible valve 36 includes a slit 38 which opens to permit flow therethrough. Although FIGS. 1 and 3 show slit 38 with four flaps 40*a*-40*d*, it is understood that the slit 38 can have from 2, or 3, or 4, or 5 to 6, or 7, or 8, or 9, or 10, or more flaps.

In an embodiment, the flexible valve 36 is integral to the extendable spout 24 and the flexible valve 36 is composed of, or otherwise is formed from, the same ethylene/α-olefin multi-block copolymer as the other spout components.

4. Seal Film

Figure 3A:
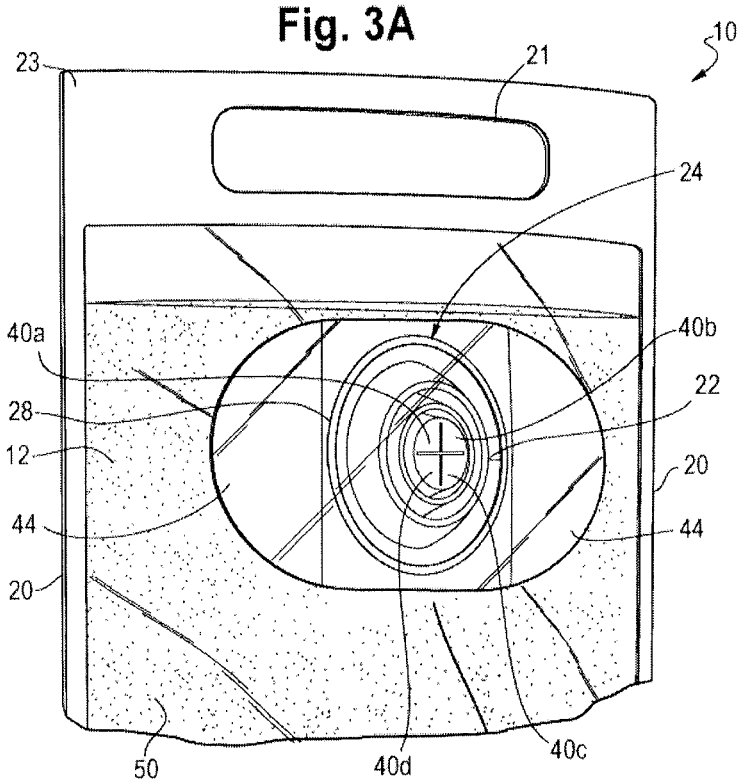
FIG. 3A is a partial perspective view of the flexible container of FIG. 1.
Figure 3B:
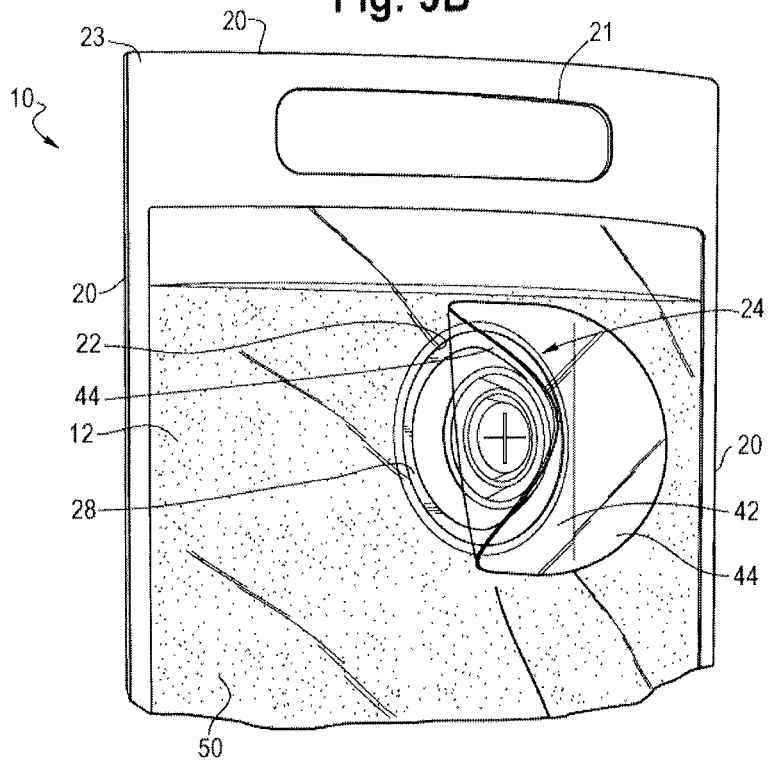
FIG. 3B is a partial perspective view of the removal of a seal film from the flexible container, in accordance with an embodiment of the present disclosure.
Figure 3C:
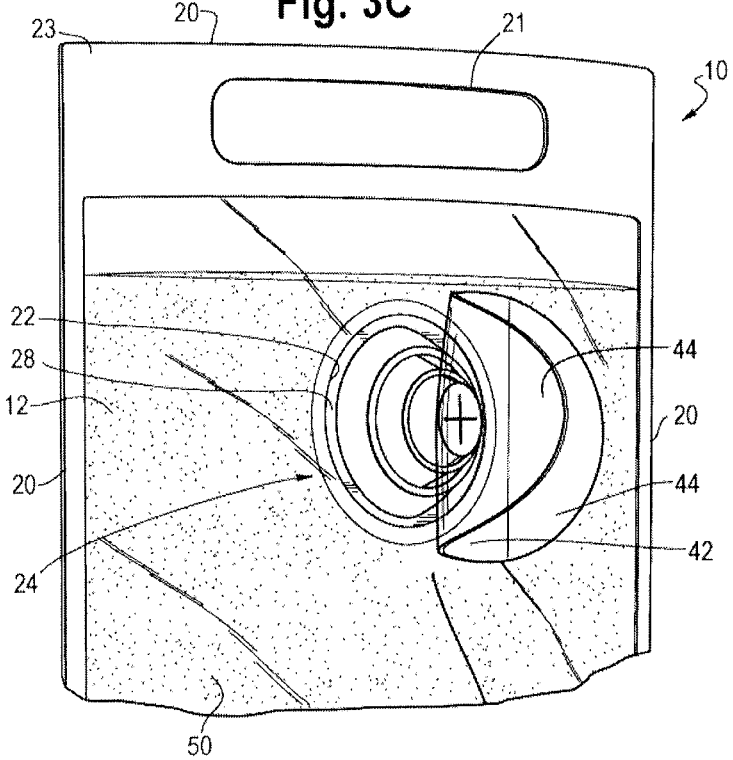
FIG. 3C is a partial perspective view of the removal of a seal film from the flexible container, in accordance with an embodiment of the present disclosure.
Figure 3D:
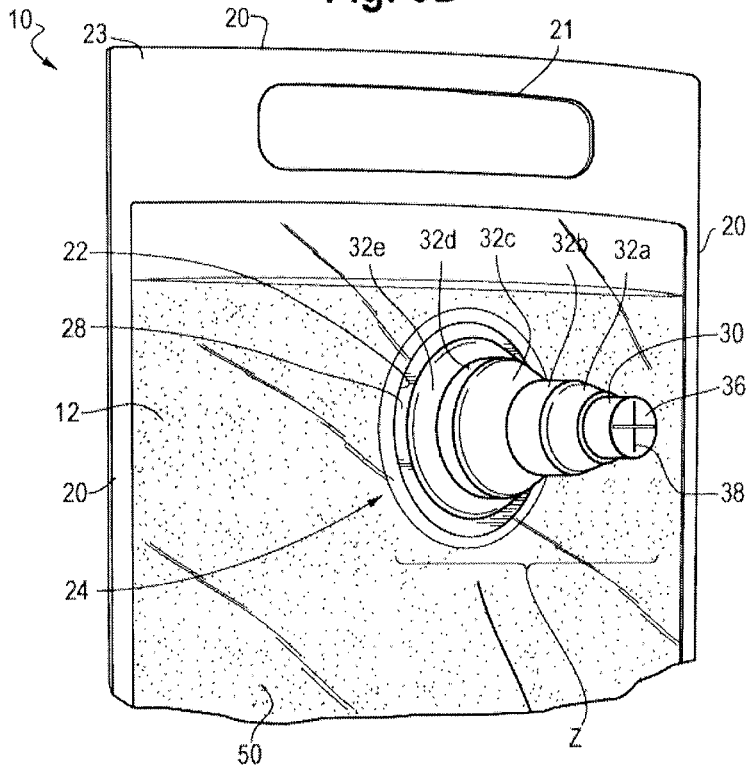
FIG. 3D is a partial perspective view of a seal film removed from the flexible container, in accordance with an embodiment of the present disclosure.

In an embodiment, the flexible container 10 includes a seal film 42. The seal film 42 is a flexible film and covers the extendable spout 24 when the extendable spout is in the compressed configuration Y. The seal film 42 is an olefin-based polymer film and includes an inner surface with adhesive material applied thereto. When in the compressed configuration Y, the extendable spout 24 has an outermost surface 46 (FIGS. 2E, 2F) that is flush, or substantially flush, with the outer surface of the front film 12. The inner surface of the seal film 42 adhesively attaches to the compressed spout as shown in FIGS. 1 and 3A. In this way, the seal film 42 covers all, or substantially all, of the spout prior to use and protects the extendable spout 24 from, dirt, contaminants, and other foreign objects until the flexible container 10 is ready for use. Seal film 42 also prevents accidental leakage of the spout and can be a closure.

In an embodiment, the seal film 42 is composed of an LLDPE with an adhesive material applied to an inner surface thereof. A nonlimiting example of a suitable LLDPE for the seal film 42 is Dowlex 2049, available from The Dow Chemical Company.

In an embodiment, the seal film 42 includes a tab 44. In this embodiment, the seal film 42 is a pressure sensitive peel seal film. Tab 44 is an area on the seal film inner surface that is void of adhesive material. As shown in FIGS. 3A-3D, pulling, or otherwise peeling, the tab 44 away from the flexible container 10 lifts the outlet 30 from the compressed configuration Y to the extended configuration Z. The removal, or peeling, of the seal film 42 from the flexible container 10 can be performed by the hand of a person. In the "extended configuration," all of the foldable panels are unfolded. It is understood that the extendable spout 24 can have multiple "partially extended configurations" whereby the spout 24 is not in the compressed configuration and one or more foldable panels is not unfolded. Once the extendable spout 24 is in the extended configuration Z, the seal film 42 is removed from the outlet 30 and the flexible container 10 is ready for use.

Figure 4:
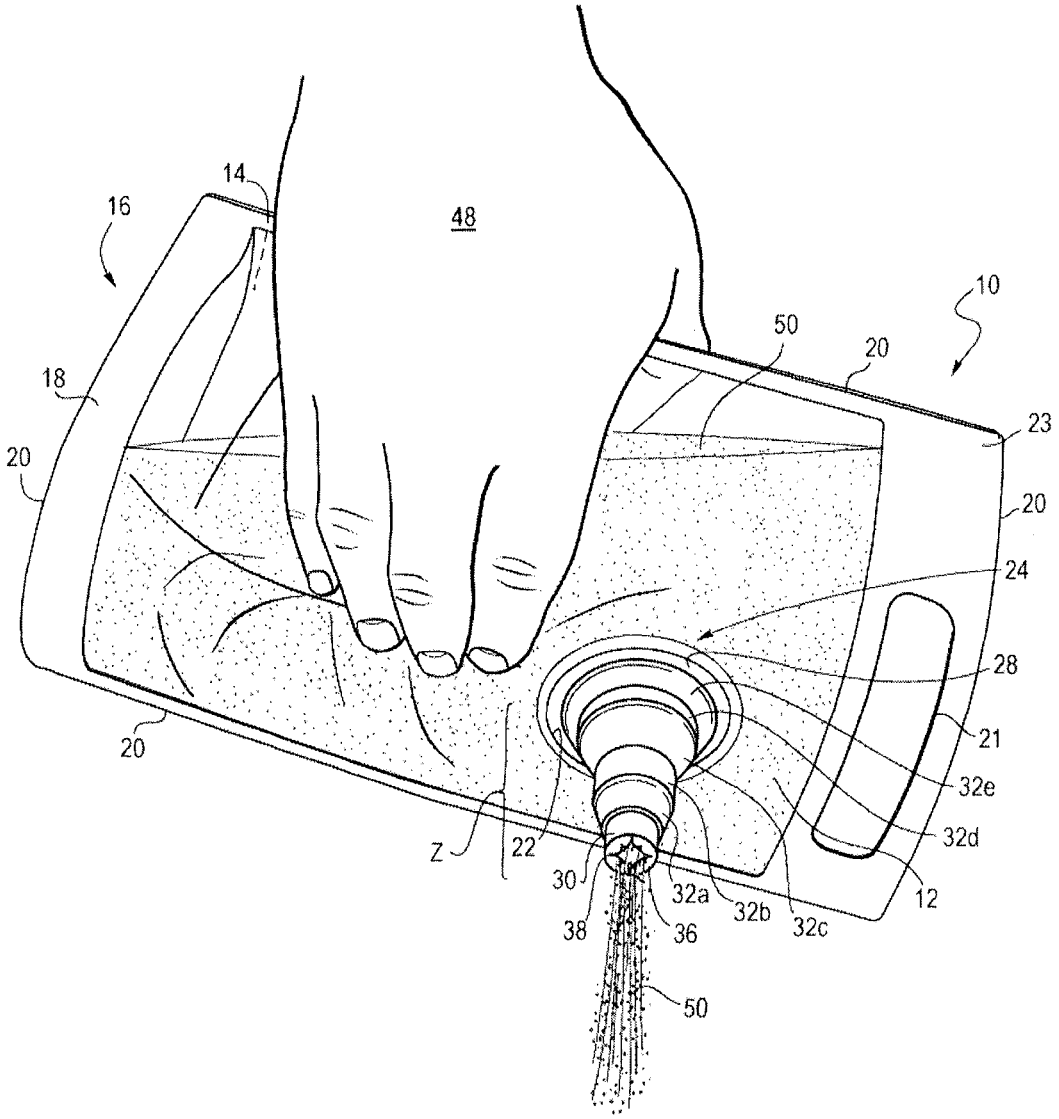
FIG. 4 is a perspective view of a flowable material being dispensed through the extendable spout in accordance with an embodiment of the present disclosure.

In an embodiment, a squeezing force applied to the flexible container 10 by a person's hand 48 is sufficient to open slit 38 of the flexible valve 36 and dispense a flowable material 50 from the interior of the flexible container as shown in FIG. 4.

In an embodiment, the length of the extendable spout 24 in the extended configuration Z is from 20 mm, or 40 mm, or 60 mm, or 80 mm, or 100 mm to 120 mm, or 140 mm, or 160 mm, or 180 mm, or 200 mm.

5. Closure

In an embodiment, the extendable spout 24 may include a closure. The outlet 30 may include threads or other structure to receive a closure. The closure is configured for mated engagement with the outlet 30. Nonlimiting examples of suitable closures, include, screw cap, flip-top cap, snap cap, tamper evident pour spout, vertical twist cap, horizontal twist cap, aseptic cap, vitop press, press tap, push on tap, lever cap, conro fitment connector, and other types of removable (and optionally reclosable) closures.

In an embodiment, the extendable spout includes a "back plug" closure." The "back-plug closure is affixed in the proximate section of the extendable spout 24. The back-plug closure fully closes the extendable spout 24 when the spout is in the compressed configuration Y.

Although FIGS. 1-4 show flexible container 10 as a stand-up pouch, the present flexible container can be a box pouch, pillow pouch, spout k-sealed pouch, spout side gusseted pouch. It is understood that the extendable spout can be installed on any film surface including front, rear, side, and gusset surfaces of the flexible container.

The present flexible container 10 can be formed with or without handles.

In an embodiment, the flexible container 10 has a volume from 0.05 liter (L), or 0.1 L, or 0.25 L, or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

6. Flexible Container

Figure 5:
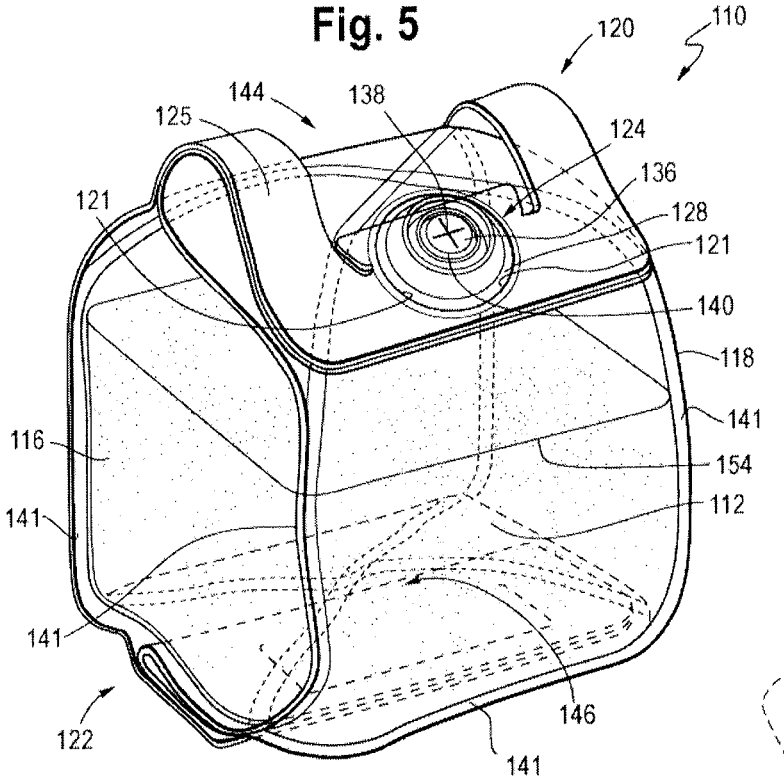
FIG. 5 is a perspective view of another flexible container with an extendable spout in accordance with an embodiment of the present disclosure.
Figure 6:
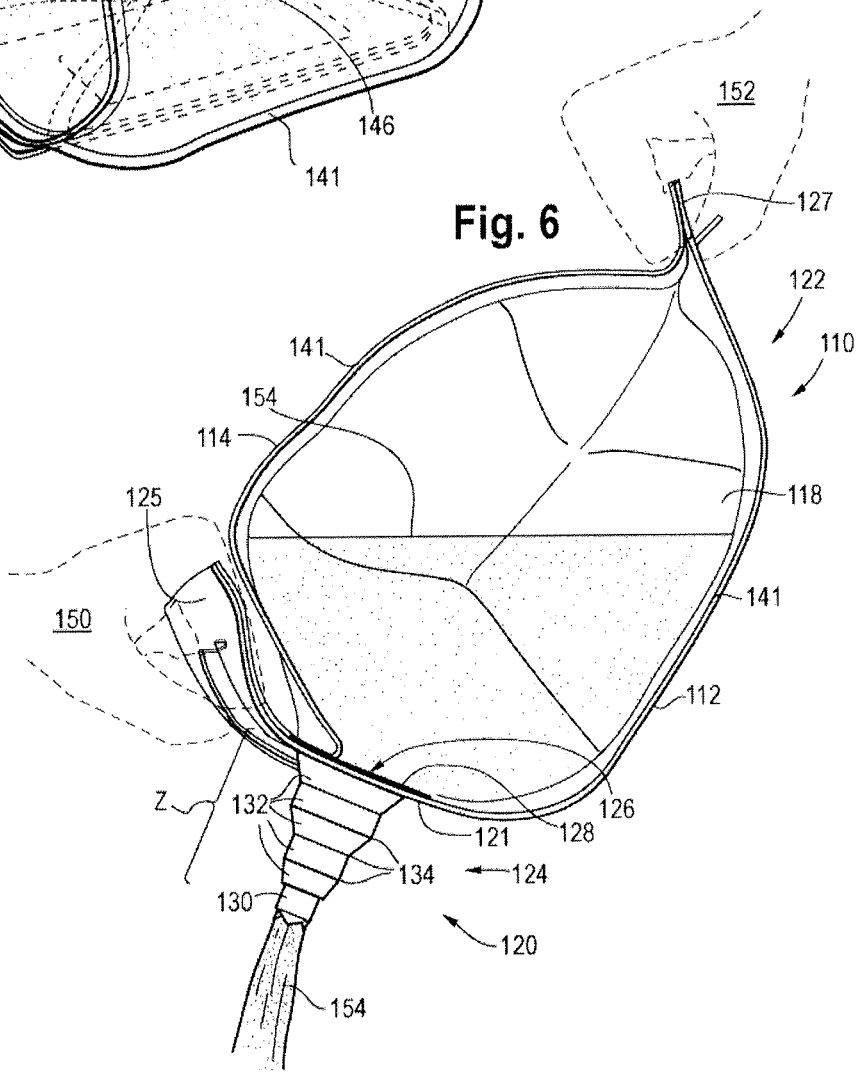
FIG. 6 is an elevation view of the flexible container of FIG. 5 showing the dispensing of a flowable material through the extendable spout in accordance with an embodiment of the present disclosure.

The present disclosure provides another flexible container. In an embodiment, a flexible container 110 is provided as shown in FIGS. 5-6. The flexible container 110 has four panels, a front panel 112, a back panel 114, a first gusset panel 116 and a second gusset panel 118. The four panels 112, 114, 116, 118, form the top segment 120 and bottom segment 122, respectively. The gusset panels 116, 118 oppose each other. The gusset panels 116, 118 fold inward when the flexible container 110 is in an empty, or a fully collapsed configuration. When the container 110 is inverted, the top and bottom positions in relation to the flexible container 110 change. However, for consistency the handle adjacent an extendable spout 124 will be called the upper handle 125 (or top handle 125) and the opposite handle will be called the lower handle 127 (or bottom handle 127).

The four panels 112, 114, 116, 118 each can be composed of a separate web of flexible multilayer film. The flexible multilayer film can be any flexible multilayer film as previously disclosed herein. The composition and structure for each web of multilayer film can be the same or different. Alternatively, one web of film may also be used to make all four panels and the top and bottom segments. In a further embodiment, two or more webs can be used to make each panel.

In an embodiment, four webs of multilayer film are provided, one web of multilayer film for each respective panel 112, 114, 116, and 118. The structure and composition for each multilayer film for the panels is the same. The front panel 112 is superimposed on the back panel 114, with the gusset panels 116, 118 located between the front panel and the rear panel. The inner seal layers for the panels face each other. The edges of the front panel 112, the rear panel 114, the first gusset panel 116, and second gusset panel 118 are aligned and form a common peripheral edge. The edges of each panel are heat sealed to the adjacent panel to form peripheral seals 141.

To form the top segment 120 and the bottom segment 122, the four panels of the multilayer film converge together at the respective end and are sealed together. For instance, the top segment 120 can be defined by extensions of the panels 112, 114, 116, 118 sealed together at the top end 144. Similarly, the bottom segment 122 can be defined by extensions of the panels 112, 114, 116, 118 sealed together at the bottom end 146. As shown in FIG. 5, the tapered portions of panels 112, 114, 116, 118 at the bottom end 146 provide sufficient support, stability, and structure to enable the flexible container 110 to be a stand-up pouch, or "SUP."

The flexible container 110 includes an orifice 121 in one of the panels in this case, in front panel 112. An extendable spout 124 extends through the orifice 121. The extendable spout 124 has a flange 128 sealed to the inner seal layer of the front panel 112 at the orifice 121. The extendable spout 124 is composed of an ethylene/α-olefin multi-block copolymer as previously disclosed.

The extendable spout 124 can be any extendable spout as previously disclosed herein (such as extendable 24, for example). The extendable spout 124 includes a channel 126, a flange 128, an outlet 130, foldable panels 132, hinges 134, flexible valve 136, slit 138, and flaps 140.

The flexible container 110 may include a seal film to cover the extendable spout 124, as previously disclosed herein.

In an embodiment, the seal film may be attached to the underside of the upper handle 125. The seal film may be any seal film as previously disclosed herein. When a user lifts the handle 125, the upward lifting force moves the spout from the compressed configuration Y to the extended configuration Z. In other words, lifting the upper handle 125 peels the seal film away from the compressed spout and also extends the spout.

In an embodiment, the extendable spout 124 enables controlled pouring of a flowable material from the flexible container. As shown in FIG. 6, a person can grasp upper handle 125 with one hand 150 and grasp the lower handle 127 with the other hand 152 to invert the flexible container 110 and accurately control the direction of the discharge of the flowable material 154 from the fully extended spout 124.

In an embodiment, the flexible container 110 has a volume from 0.05 liter (L), or 0.1 L, or 0.25 L, or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

In an embodiment, the flexible container 10 and/or the flexible container 110 is made from 90 wt % to 100 wt % ethylene-based polymer—the multilayer films being composed of flexible multiple layer film with layer materials selected from ethylene-based polymer such as LLDPE, LDPE, HDPE, and combinations thereof, and the fitment 10 composed of ethylene/α-olefin multi-block copolymer. Weight percent is based on total weight of the flexible container (without content). The flexible container made from 90 wt % to 100 wt % ethylene-based polymer is advantageous as it is readily recyclable.

The present flexible container is suitable for storage of flowable substances including, but not limited to, liquid comestibles (such as beverages), oil, paint, grease, chemicals, suspensions of solids in liquid, and solid particulate matter (powders, grains, granular solids). Nonlimiting examples of suitable liquids include liquid personal care products such as shampoo, conditioner, liquid soap, lotion, gel, cream, balm, and sunscreen. Other suitable liquids include household care/cleaning products and automotive care products. Other liquids include liquid food such as condiments (ketchup, mustard, mayonnaise) and baby food.

The present flexible container is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

By way of example, and not limitation, examples of the present disclosure are provided.

EXAMPLES

Example 1

An extendable spout is injection molded from ethylene/α-olefin multi-block copolymer sold under the tradename Infuse™ 9817, available from The Dow Chemical Company. Attempts to injection mold the extendable spout using Versify™ 4301 propylene random copolymer failed due to slow injection molding cycle and severe part deformity when extracted out of the mold.

The structure of the Example 1 extendable spout is the same as, or substantially the same as, the structure of extendable spout 24 shown in FIGS. 2A-2F. The dimensions of the Example 1 extendable spout are provided in Table 1 below.

TABLE 1

Dimensions - Example 1 Extendable Spout

| Component (FIGS. 2A-2F) | Thickness (mm) | Start External Diameter (mm) | End External Diameter (mm) | Cumulative height from flange 28 | Height |
|---|---|---|---|---|---|
| Outlet 30 | 0.1 | 12 | 12 | 42.5 | 7.0 |
| FP 32a | 0.5 | 12 | 16 | 35.5 | 7.0 |
| FP 32b | 0.5 | 16 | 16 | 28.5 | 7.0 |
| FP 32c | 0.5 | 16 | 24 | 21.5 | 7.0 |
| FP 32d | 0.5 | 24 | 24 | 14.5 | 7.0 |
| FP 32e | 0.5 | 24 | 32 | 7.5 | 7.0 |
| Flange 28* | 0.5 | 32 | 42 | 0.5 | 0.5 |
| Spout Total Height | | | | | 42.5 |

+FP = foldable panel

*Flange height and flange thickness is same dimension

The extendable spouts are made in two versions with a flexible valve located (i) at the bottom end of the outlet 30 (spout 1) and (2) at the top of the outlet 30 (spout 2) (for a simple one time "refill" package type use).

The extendable spouts are installed in a pre-made stand-up pouch made with film structure (Film 1) listed in Table 2 below. Film 1 is designed to be a robust film for multiple applications.

TABLE 2

Structure of the 120 micrometer thick film used for Example 1 (Film 1)

| Material | Description | Density (g/cm3) ASTM D792 | Melt Index (g/10 min) ASTM D1238 | Melting Point (° C.) DSC | Thickness (microns) |
|---|---|---|---|---|---|
| LLDPE | Dowlex ™ 2049 | 0.926 | 1 | 121 | 20 |
| HDPE | Elite ™ 5960G | 0.962 | 0.85 | 134 | 20 |
| LLDPE | Elite ™ 5400G | 0.916 | 1 | 123 | 19 |
| Adhesive Layer | Polyurethane solvent less adhesive (ex. Morfree 970/CR137) - | | | | 2 |
| HDPE | Elite ™ 5960G | 0.962 | 0.85 | 134 | 19 |
| HDPE | Elite ™ 5960G | 0.962 | 0.85 | 134 | 20 |
| Heat Seal Layer | Affinity ™ 1146 | 0.899 | 1 | 95 | 20 |
| Total | | | | | 120 |

Procedure to Install the Extendable Spout:

1. An orifice hole with a 35 mm diameter is opened in the front film with a scalpel.
2. The spout with the outlet closed on the top (spout 2) is positioned in the internal part of the package centralized with the hole and supported by a metal ring with sufficient height to fully enclose the extendable spout.
3. A small section of a metal pipe of the exact same dimensions as the flange 28 (42 mm external diameter, 32 mm internal diameter) is heated to 130° C. and hand pressed against the external part of the package, i.e., against the package film for 3 to 5 seconds.
4. A seal film is prepared in advance by coating a piece of Film 1 with Robond™ 8915 pressure sensitive adhesive, which is commonly used for removable label applications. The two ends of the seal film are uncoated to form tabs which can be used to easily remove the seal film by hand. The seal film is firmly adhered to the edges of the extendable spout and the center section.
5. The edge of the outlet is welded to the seal film by pressing by hand against a heated rod at 130° C. for 3 to 5 seconds, to assure proper functionality of the extendable spout. This operation would not be required in industrial scale operation depending on the chosen configuration of the spout.

Use of the Flexible Container

The use of the extendable spout can be seen in sequence of pictures in FIGS. 3A-F.

1. The extendable spout in the compressed configuration Y does not interfere in the overall thickness of the unfilled SUP.
2. The side tabs left uncoated in the seal film can be easily pulled from the flexible container surface by hand.
3. Since the edges of the outlet are welded to the seal film, the entire spout is readily pulled out to its fully extended configuration Z.
4. A small additional force is sufficient to remove the seal film from the outlet, exposing the outlet.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A flexible container comprising:

a first multilayer film and a second multilayer film, each multilayer film comprising an inner seal layer, the multilayer films arranged such that the seal layers oppose each other and the second multilayer film is superimposed on the first multilayer film, the multilayer films sealed along a common peripheral edge;

an orifice in one of the multilayer films;

an extendable spout extending through the orifice and having a flange sealed to the inner seal layer of the multilayer film at the orifice, the extendable spout comprising an ethylene/ α-olefin multi-block copolymer having a melt temperature, Tm1, from 115° C. to 125° C., wherein each seal layer comprises an olefin-based polymer having melt temperature, Tm2, and Tm2 is from 10° C. to 40° C. less than Tm1.

2. The flexible container of claim 1 wherein the extendable spout comprises an outlet; and a plurality of foldable panels integrally connecting the flange to the outlet.

3. The flexible container of claim 2 wherein the extendable spout has a compressed configuration wherein each foldable panel is folded; and a seal film is adhesively attached over the flexible spout in the compressed configuration.

4. The flexible container of claim 2 wherein the extendible spout has an extended configuration wherein each panel is unfolded.

5. The flexible container of claim 2 comprising a closure for mated engagement with the outlet.

6. The flexible container of claim 1 wherein the extendable spout defines a channel, and the extendable spout comprises a flexible valve extending across the channel and having a slit which opens to permit flow therethrough, the flexible valve comprising the ethylene/α-olefin multi-block copolymer.

7. The flexible container of claim 6 wherein the flexible valve is located in the outlet.

8. The flexible container of claim 6 wherein the flexible valve is integral to the extendable spout.

9. The flexible container of claim 1 wherein the extendable spout is an injection molded spout.

10. A flexible container comprising:

a front panel and a rear panel, the front panel superimposed on the rear panel;

a first gusset panel and a second gusset panel located between the front panel and the rear panel, each panel composed of a multilayer film and each multilayer film comprising an inner seal layer, the panels heat sealed along a common peripheral edge;

an orifice in one of panels;

an extendable spout extending through the orifice and having a flange sealed to the inner seal layer of the panel at the orifice, the extendable spout comprising an ethylene/α-olefin multi-block copolymer having a melt temperature, Tm1, from 115° C. to 125° C., wherein each seal layer comprises an olefin-based polymer having melt temperature, Tm2, and Tm2 is from 10° C. to 40° C. less than Tm1.

11. The flexible container of claim 10 wherein the extendable spout is located in the front panel.

12. The flexible container of claim 10 wherein the extendable spout is located in a top segment of the flexible container.

13. The flexible container of claim 10 comprising an upper handle.

14. The flexible container of claim 10 comprising a lower handle.

* * * * *